US011084992B2

(12) United States Patent
Ding et al.

(10) Patent No.: US 11,084,992 B2
(45) Date of Patent: Aug. 10, 2021

(54) SYSTEMS AND METHODS FOR UPGRADING HEAVY OILS

(71) Applicant: Saudi Arabian Oil Company, Dhahran (SA)

(72) Inventors: Lianhui Ding, Dhahran (SA); Essam Al-Sayed, Al-Khobar (SA); Ibrahim Abba, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 509 days.

(21) Appl. No.: 15/605,575

(22) Filed: May 25, 2017

(65) Prior Publication Data

US 2017/0349846 A1 Dec. 7, 2017

Related U.S. Application Data

(60) Provisional application No. 62/344,701, filed on Jun. 2, 2016.

(51) Int. Cl.
*C10G 69/04* (2006.01)
*C10G 69/02* (2006.01)
(Continued)

(52) U.S. Cl.
CPC ..... *C10G 69/04* (2013.01); *C10G 45/08* (2013.01); *C10G 65/12* (2013.01); *C10G 67/02* (2013.01);
(Continued)

(58) Field of Classification Search
CPC ..... C10G 69/04; C10G 67/02; C10G 65/12; C10G 69/02; C10G 45/08; C10G 2300/308
See application file for complete search history.

(56) References Cited

U.S. PATENT DOCUMENTS 2,358,150 A 4/1941 Cooke
3,607,725 A 9/1971 Irvine et al.
(Continued)

FOREIGN PATENT DOCUMENTS

CN 1362481 8/2002
CN 101824337 9/2010
(Continued)

OTHER PUBLICATIONS

Office Action pertaining to U.S. Appl. No. 15/683,071 dated Sep. 6, 2018.
(Continued)

*Primary Examiner* — Randy Boyer
*Assistant Examiner* — Juan C Valencia
(74) *Attorney, Agent, or Firm* — Dinsmore & Shohl LLP

(57) ABSTRACT

In accordance with one embodiment of the present disclosure, a heavy oil may be upgraded by a process that may include removing at least a portion of metals from the heavy oil in a hydrodemetalization reaction zone to form a hydrodemetalization reaction effluent, removing at least a portion of metals and at least a portion of nitrogen from the hydrodemetalization reaction effluent in a transition reaction zone to form a transition reaction effluent, removing at least a portion of nitrogen from the transition reaction effluent in a hydrodenitrogenation reaction zone to form a hydrodenitrogenation reaction effluent, and reducing aromatics content in the hydrodenitrogenation reaction effluent in a hydrocracking reaction zone by contacting the hydrodenitrogenation reaction effluent to form an upgraded fuel.

39 Claims, 3 Drawing Sheets

(51) Int. Cl.
*C10G 65/12* (2006.01)
*C10G 45/08* (2006.01)
*C10G 67/02* (2006.01)

(52) U.S. Cl.
CPC ..... *C10G 69/02* (2013.01); *C10G 2300/308* (2013.01)

(56) References Cited

U.S. PATENT DOCUMENTS 3,617,493 A 11/1971 Wirth et al.
3,730,879 A 5/1973 Christman et al.
3,755,143 A 8/1973 Hosoi et al.
3,830,720 A 8/1974 Misaki et al.
3,856,659 A 12/1974 Owen
3,862,838 A 1/1975 Sloboda
3,862,898 A 1/1975 Boyd et al.
3,876,523 A 4/1975 Rosinski
4,016,067 A 4/1977 Fischer et al.
4,133,777 A 1/1979 Frayer et al.
4,134,824 A 1/1979 Kamm et al.
4,153,539 A 5/1979 Herrington et al.
4,264,435 A 4/1981 Read et al.
4,297,203 A 10/1981 Ford et al.
4,436,706 A 3/1984 Nacken et al.
4,510,042 A * 4/1985 Billon ..... C10G 45/04 208/59
4,527,003 A 7/1985 Okamoto et al.
4,587,011 A 5/1986 Okamoto et al.
4,655,904 A 4/1987 Okamoto et al.
4,725,349 A 2/1988 Okamoto et al.
4,830,728 A 5/1989 Herbst et al.
4,832,823 A 5/1989 Goyal et al.
4,992,160 A 2/1991 Long et al.
5,009,768 A 4/1991 Galiasso et al.
5,019,240 A * 5/1991 Best ..... B01J 29/061 208/111.01
5,171,331 A 12/1992 Debras et al.
5,233,121 A 8/1993 Modica
5,435,907 A * 7/1995 Sudhakar ..... C10G 45/50 208/143
5,523,502 A 6/1996 Rubin
5,603,824 A 2/1997 Kyan et al.
5,871,650 A 2/1999 Lai et al.
5,904,837 A 5/1999 Fujiyama
5,906,728 A 5/1999 Iaccino et al.
5,951,850 A 9/1999 Ino et al.
5,954,947 A 9/1999 Mignard et al.
5,958,365 A 9/1999 Liu
6,033,555 A 3/2000 Chen et al.
6,123,830 A 9/2000 Gupta et al.
6,190,533 B1 2/2001 Bradow et al.
6,190,538 B1 2/2001 Gosselink et al.
6,210,562 B1 4/2001 Xie et al.
6,316,674 B1 11/2001 Kantam et al.
6,383,975 B1 * 5/2002 Rocha ..... B01J 21/063 208/113
6,384,285 B1 5/2002 Choudary et al.
6,656,346 B2 12/2003 Ino et al.
6,743,961 B2 6/2004 Powers
6,811,684 B2 11/2004 Mohr et al.
6,979,757 B2 12/2005 Powers
6,982,074 B2 1/2006 Jan et al.
7,019,187 B2 3/2006 Powers
7,094,333 B2 8/2006 Yang et al.
7,374,664 B2 5/2008 Powers
7,396,449 B2 7/2008 Powers
7,404,889 B1 7/2008 Powers
7,419,584 B2 9/2008 Stell et al.
7,550,642 B2 6/2009 Powers
7,744,747 B2 6/2010 Halsey
7,785,563 B2 8/2010 Ryoo et al.
7,858,834 B2 12/2010 Powers
7,972,498 B2 7/2011 Buchanan et al.
8,658,019 B2 2/2014 Bridges et al.
9,096,806 B2 8/2015 Abba et al.
9,228,139 B2 1/2016 Raheel Shall et al.
9,228,140 B2 1/2016 Abba et al.
9,228,141 B2 1/2016 Sayed et al.
9,255,230 B2 2/2016 Shafi et al.
9,279,088 B2 3/2016 Shafi et al.
9,284,497 B2 3/2016 Bourane et al.
9,284,501 B2 3/2016 Sayed et al.
9,284,502 B2 3/2016 Bourane et al.
9,296,961 B2 3/2016 Shafi et al.
2005/0133405 A1 6/2005 Wellington et al.
2006/0118462 A1 6/2006 Schulze-Trautmann et al.
2006/0207917 A1 9/2006 Domokos et al.
2006/0260981 A1 11/2006 Gosling
2007/0090018 A1 4/2007 Keusenkothen et al.
2007/0108100 A1 5/2007 Satchell, Jr.
2007/0209968 A1 * 9/2007 Euzen ..... B01J 21/12 208/108
2008/0277314 A1 11/2008 Halsey
2008/0283445 A1 11/2008 Powers
2009/0050523 A1 2/2009 Halsey
2009/0218255 A1 9/2009 Claude et al.
2009/0272674 A1 11/2009 Zheng et al.
2010/0018904 A1 * 1/2010 Kressmann ..... C10G 45/18 208/210
2010/0122932 A1 5/2010 Haizmann et al.
2010/0155293 A1 * 6/2010 Verstraete ..... C10G 65/12 208/49
2010/0230323 A1 9/2010 Ancheyta Juárez et al.
2011/0083996 A1 4/2011 Shafi et al.
2012/0061294 A1 3/2012 Choi et al.
2012/0237439 A1 * 9/2012 Rouleau ..... C04B 38/00 423/628
2012/0279728 A1 11/2012 Northrop et al.
2013/0118954 A1 * 5/2013 Wu ..... B01J 29/146 208/111.3
2013/0197285 A1 8/2013 Shafi et al.
2013/0220884 A1 8/2013 Bourane et al.
2013/0248416 A1 9/2013 Shafi et al.
2013/0248417 A1 9/2013 Sayed et al.
2013/0248419 A1 9/2013 Abba et al.
2013/0292299 A1 11/2013 Koseoglu et al.
2014/0221712 A1 8/2014 Greene et al.
2015/0001130 A1 1/2015 Akhras et al.
2016/0369185 A1 12/2016 Ward et al.
2017/0306245 A1 * 10/2017 Lindberg ..... C10G 32/02
2018/0147567 A1 * 5/2018 Matsushita ..... B01J 35/1042

FOREIGN PATENT DOCUMENTS

CN 101890383 11/2010
EP 0197289 A2 10/1986
EP 1600491 A1 11/2005
GB 978576 12/1964
JP H06277439 A 10/1994
WO 98/39096 9/1998
WO 2015/000842 A1 1/2015
WO 2015000847 A1 1/2015
WO 2015128040 A1 9/2015
WO 2015128041 A1 9/2015
WO 2016059569 A1 4/2016

OTHER PUBLICATIONS

Rana et al., "A Review of Recent Advances on Process Technologies for Upgrading of Heavy Oils and Residua", Fuel, 2007, 86, 1216-1231.
International Search Report and Written Opinion pertaining to PCT/US2018/042016 dated Oct. 8, 2018.
International Search Report and Written Opinion pertaining to PCT/US2018/042020 dated Oct. 8, 2018.
International Search Report and Written Opinion pertaining to PCT/US2018/028592 dated Jun. 27, 2018.
Penrose et al., "Enhancing Refinery Profitability by Gasification, Hydroprocessing & Power Generation", Gasification Technologies Conference, Oct. 1999, San Francisco, CA., Texaco Power & Gasification.

(56) References Cited

OTHER PUBLICATIONS

International Search Report and Written Opinion pertaining to International Application No. PCT/US2018/042011 dated Jan. 2, 2019, 20 pages.
International Search Report and Written Opinion pertaining to International Application No. PCT/US2018/042015 dated Jan. 2, 2019, 20 pages.
Examination Report dated Dec. 31, 2018 pertaining to GCC Patent Application No. GC 2017133492, 6 pages.
Baric, John, "Next-Level Hydrocracker Flexibility: Unlocking High Pertormance in Today's Turbulent Markets", Shell Global Solutions, 2016, 3-18.
Ding et al., "LCO Hydrotreating with Mo-Ni and W-Ni Supported on Nano- and Micro-Sized Zeolite Beta", Applied Catalysis A: General, 2009, 353 17-23.
Garcia-Martinez et al., "Mesostructured Zeolite Y-High Hydrothermal Stability and Superior FCC Catalytic Performance", Catal. Sci. Technol., 2012, 2, 987-994.
International Search Report and Written Opinion pertaining to PCT/US2017/026498 dated Jun. 30, 2017.
International Search Report and Written Opinion pertaining to PCT/US2017/035202 dated Aug. 7, 2017.
International Search Report and Written Opinion pertaining to PCT/US2017/048130 dated Oct. 18, 2017.
Liu et aL, "Y/MCM-41 Composites Assembled from Nanocrystals", Microporous and Mesoporous Materials, 2013, 181, 116-122.
Varoshiotis, Andy, "Cyprus New Energy Economy Focus Should be in the Petrochemicals", 2015, Linkedin.
Zhang et al., "Preparation and Characterization of Beta/MCM-41 Composite Zeolite with a Stepwise-Distributed Pore Structure", Powder Technology, 2008, 73-78.
Examination Report dated Apr. 15, 2019 pertaining to GCC Patent Application No. 2017/33195, filed Apr. 11, 2017, 5 pages.
Examination Report dated Apr. 2, 2019 pertaining to GCC Patent Application No. 2017/33492, filed Jun. 1, 2017, 5 pages.
U.S. Office Action dated Mar. 12, 2019 pertaining to U.S. Appl. No. 15/480,917, filed Apr. 6, 2017, 46 pgs.
U.S. Office Action dated Jun. 27, 2019 pertaining to U.S. Appl. No. 15/944,068, filed Apr. 3, 2018, 50 pgs.
Office Action dated Jul. 30, 2019 pertaining to U.S. Appl. No. 15/480,917, filed Apr. 6, 2017, 30 pgs.
Office Action dated Sep. 17, 2019 pertaining to U.S. Appl. No. 16/036,319, filed Jul. 16, 2018, 49 pgs.
Office Action dated Sep. 13, 2019 pertaining to U.S. Appl. No. 16/036,283, filed Jul. 16, 2018, 50 pgs.
Office Action dated Sep. 12, 2019 pertaining to U.S. Appl. No. 16/036,260, filed Jul. 16, 2018, 48 pgs.
Examination Report dated Mar. 12, 2019 pertaining to GCC Patent Application No. 2017/33869, filed Aug. 23, 2017, 4 pages.
Examination Report dated Jan. 29, 2020 which pertains to GCC Patent Application No. 2018/35655 with a filing date of Jul. 17, 2018, 5 pages.
Notice of Allowance dated Feb. 19, 2020, pertaining U.S. Appl. No. 16/036,260, 17 pages.
Notice of Allowance dated Feb. 20, 2020, pertaining U.S. Appl. No. 16/036,283, 18 pages.
Notice of Allowance dated Feb. 20, 2020, pertaining U.S. Appl. No. 16/036,319, 18 pages.
Office Action dated Mar. 24, 2020 pertaining to U.S. Appl. No. 16/789,879, filed Feb. 13, 2020, 12 pgs.
Pural Catapal High-purity alumina hydrates information sheet, SASOL Performance Chemicals, pp. 1-16, no date available.
Notice of Allowance and Fee(s) Due dated Nov. 20, 2019 pertaining to U.S. Appl. No. 15/480,917, filed Apr. 6, 2017, 13 pgs.
Notice of Allowance and Fee(s) Due dated Jan. 13, 2020 pertaining to U.S. Appl. No. 15/944,068, filed Apr. 3, 2018, 8 pgs.
Examination Report pertaining to Application No. GC2018-35195 dated Nov. 26, 2019.
GCC Examination Report dated May 31, 2020 pertaining to GCC Patent Application No. GC 2018-35658 3 pgs.
European Official Action dated Jul. 20, 2020 pertaining to European Patent Application No. 17719100.4, 5 pgs.
Office Action dated Oct. 1, 2020 pertaining to U.S. Appl. No. 16/036,304, filed Jul. 16, 2018, 83 pgs.
Examination Report pertaining to GC2018-35195 dated Sep. 20, 2020.
European Official Action dated Aug. 27, 2020 pertaining to European Patent Application No. 17761417.9, 5 pages.
Notice of Allowance and Fee(s) Due dated Sep. 11, 2020 pertaining to U.S. Appl. No. 161789,879 filed Feb. 13, 2020, 37 pgs.
Notice of Allowance and Fee(s) Due dated Jan. 12, 2021 pertaining to U.S. Appl. No. 16/036,304, filed Jul. 16, 2018, 18 pgs.

* cited by examiner

SYSTEMS AND METHODS FOR UPGRADING HEAVY OILS

CROSS REFERENCE TO RELATED APPLICATIONS

This application claims priority to U.S. Provisional Patent Application Ser. No. 62/344,701 filed Jun. 2, 2016, which is incorporated by reference herein in its entirety.

BACKGROUND

Field

The present disclosure relates to a process for the treatment of heavy oils, including crude oils, using a catalytic pretreatment process. More specifically, the disclosure relates to the use of a series of hydrotreating catalysts to upgrade a heavy oil prior to subsequent chemical processing of the upgraded heavy oil.

Technical Background

Heavy oil feedstocks may be upgraded in order to improve downstream efficiency in refining operations. Upgrading processes may include hydroprocessing treatments, which remove unwanted components from the heavy oil feedstock, and may additionally include hydrocracking treatments which crack oil feedstocks prior to conventional refining operations. For example, nitrogen and sulfur may be partially removed from the feedstock stream prior to further refinement. However, existing catalysts utilized in hydroprocessing pretreatments have limitations in catalytic activity, such as the cracking of aromatic moieties in an oil feedstock.

BRIEF SUMMARY

There is a need for catalytic treatment processes and catalysts for use in such processes which have enhanced catalytic functionality and, in particular, have enhanced aromatic cracking functionality. The presently described catalytic treatment processes may have enhanced catalytic functionality with regards to reducing at least aromatic content, metal content, and nitrogen content in a crude oil feedstock which is subsequently refined into desired petrochemical products. According to one or more embodiments, heavy oils may be treated by four catalysts arranged in series, where the primary function of the first catalyst (that is, the hydrodemetalization catalyst) is to remove metals from the heavy oil, the primary function of the second catalyst (that is, the transition catalyst) is to remove metals and nitrogen from the heavy oil and to provide a transition area between the first and second catalysts, the primary function of the third catalyst (that is, the hydrodenitrogenation catalyst) is to remove nitrogen from the heavy oil, and the primary function of the fourth catalyst (that is, the hydrocracking catalyst) is to reduce aromatic content in the heavy oil.

In accordance with one embodiment of the present disclosure, a heavy oil may be upgraded by a process that may comprise removing at least a portion of metals from the heavy oil in a hydrodemetalization reaction zone to form a hydrodemetalization reaction effluent, removing at least a portion of metals and at least a portion of nitrogen from the hydrodemetalization reaction effluent in a transition reaction zone to form a transition reaction effluent, removing at least a portion of nitrogen from the transition reaction effluent in a hydrodenitrogenation reaction zone to form a hydrodenitrogenation reaction effluent, and reducing aromatics content in the hydrodenitrogenation reaction effluent in a hydrocracking reaction zone by contacting the hydrodenitrogenation reaction effluent to form an upgraded fuel. The transition reaction zone may be positioned downstream of the hydrodemetalization reaction zone, the hydrodenitrogenation reaction zone may be positioned downstream of the transition reaction zone and the hydrocracking reaction zone may be positioned downstream of the hydroprocessing reaction zone. The hydrocracking reaction zone may comprise a hydrocracking catalyst comprising a mesoporous zeolite and one or more metals, where the mesoporous zeolite has an average pore size of from 2 nanometers (nm) to 50 nm.

In accordance with another embodiment of the present disclosure, a heavy oil may be upgraded by a process that may comprise introducing a stream comprising the heavy oil to a hydrodemetalization reaction zone comprising hydrodemetalization catalyst, removing at least a portion of metals from the heavy oil in a hydrodemetalization reaction zone to form a hydrodemetalization reaction effluent, passing the hydrodemetalization reaction effluent from the hydrodemetalization reaction zone to a transition reaction zone comprising a transition catalyst, removing at least a portion of metals and a portion of nitrogen from the hydrodemetalization reaction effluent in the transition reaction zone to form a transition reaction effluent, passing the transition reaction effluent from the transition reaction zone to a hydrodenitrogenation reaction zone comprising a hydrodenitrogenation catalyst, removing at least a portion of nitrogen from the transition reaction effluent in the hydrodenitrogenation reaction zone to form a hydrodenitrogenation reaction effluent, passing the hydrodenitrogenation reaction effluent to a hydrocracking reaction zone comprising a hydrocracking catalyst, and reducing aromatics content in the hydrodenitrogenation reaction effluent in the hydrocracking reaction zone to form an upgraded fuel. The hydrocracking reaction zone may comprise a hydrocracking catalyst comprising a mesoporous zeolite and one or more metals, where the mesoporous zeolite has an average pore size of from 2 nm to 50 nm.

In accordance with yet another embodiment of the present disclosure, a hydroprocessing reactor may comprise a hydrodemetalization catalyst, a transition catalyst positioned downstream of the hydrodemetalization catalyst, a hydrodenitrogenation catalyst positioned downstream of the transition catalyst, and a hydrocracking catalyst positioned downstream of the hydrodenitrogenation catalyst. The hydrocracking catalyst may comprise a mesoporous zeolite and one or more metals, where the mesoporous zeolite has an average pore size of from 2 nm to 50 nm.

Additional features and advantages of the technology described in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
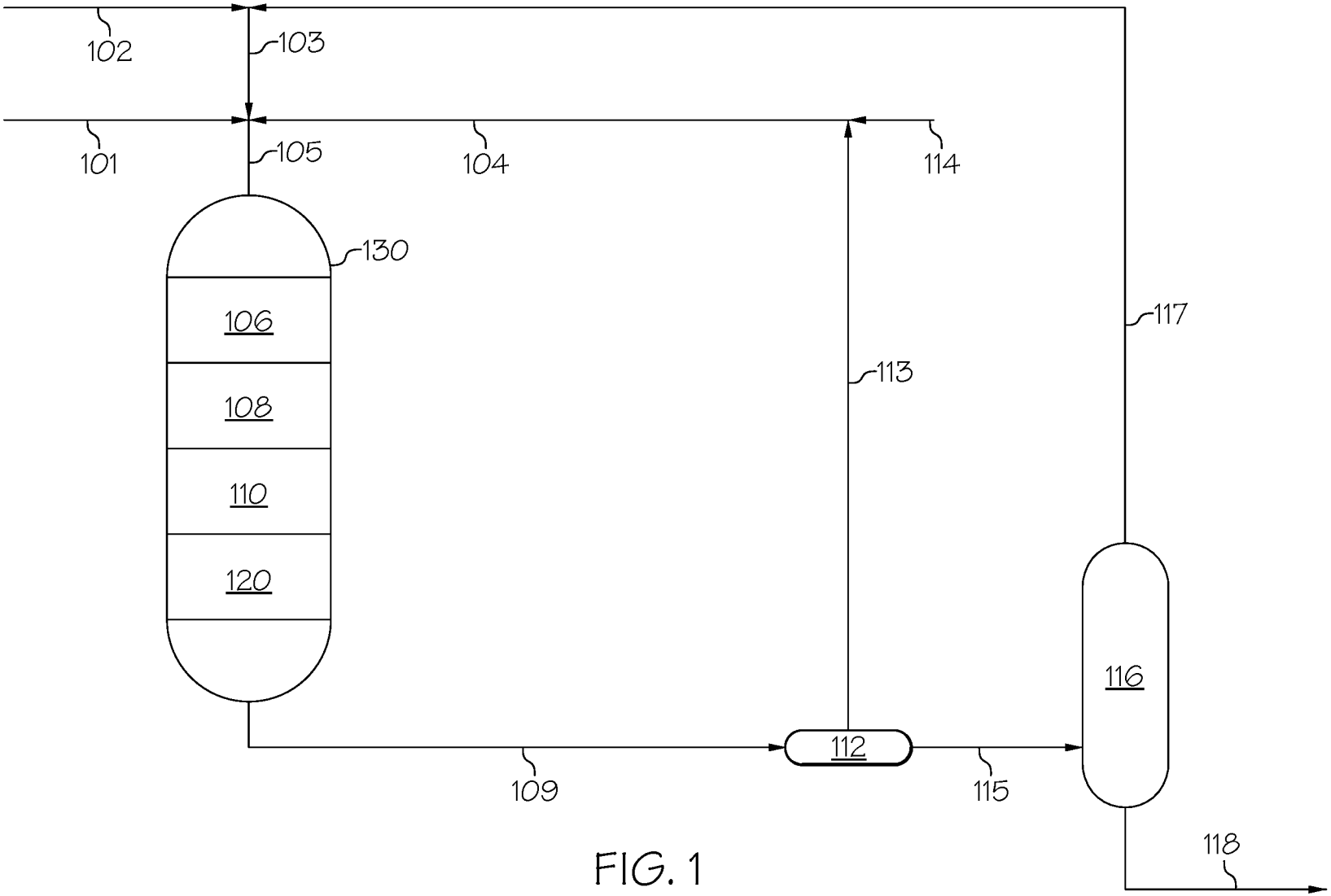
FIG. 1 is a generalized diagram of a chemical pretreatment system which includes a pretreatment reactor comprising a hydrodemetalization (HDM) catalyst, a transition catalyst, a hydrodenitrogenation (HDN) catalyst, and a hydrocracking catalyst, according to one or more embodiments described in this disclosure.
Figure 2:
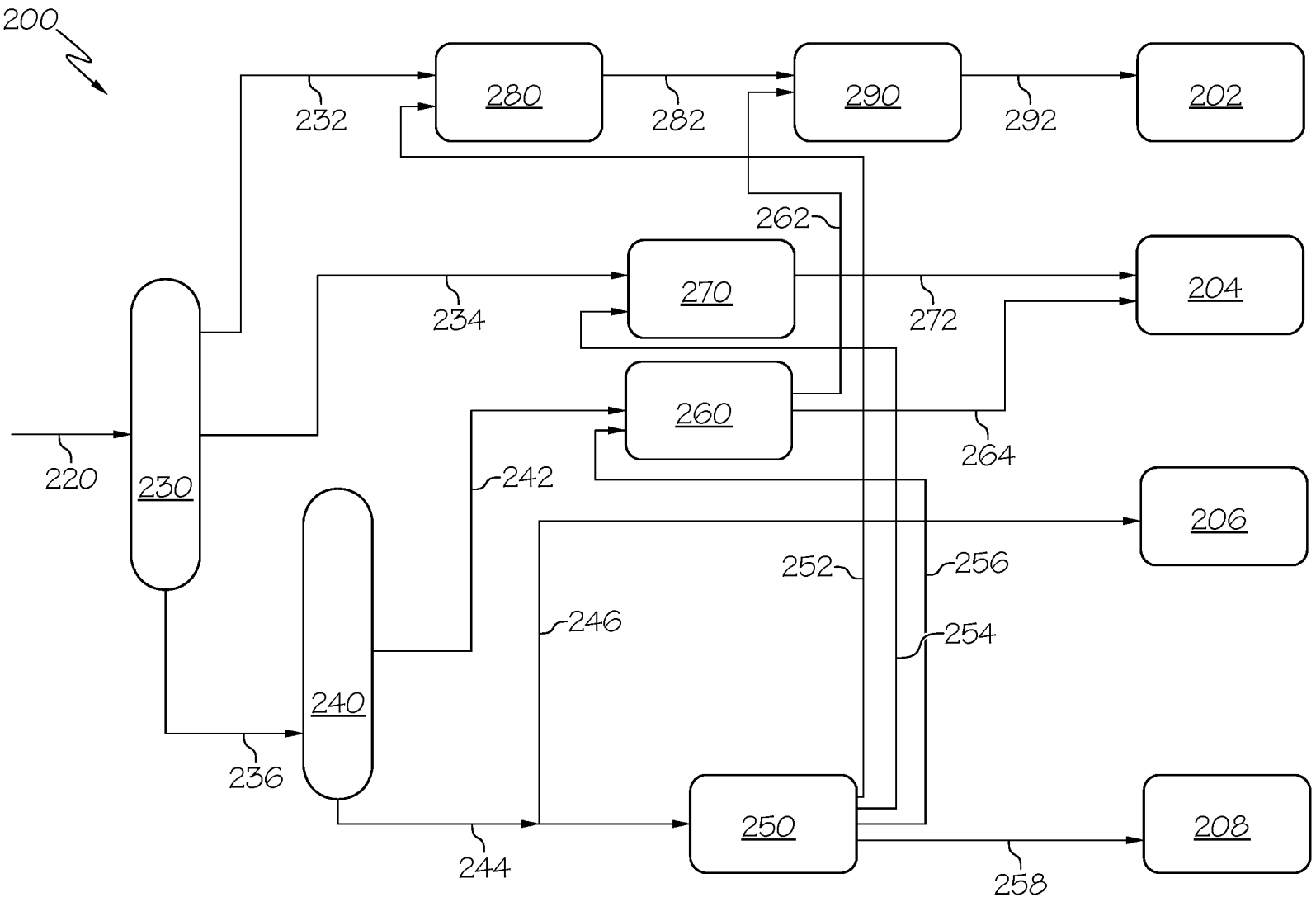
FIG. 2 is a generalized diagram of a chemical processing system utilized subsequent to the chemical pretreatment system of FIG. 1 which includes a hydrocracking unit, according to one or more embodiments described in this disclosure.
Figure 3:
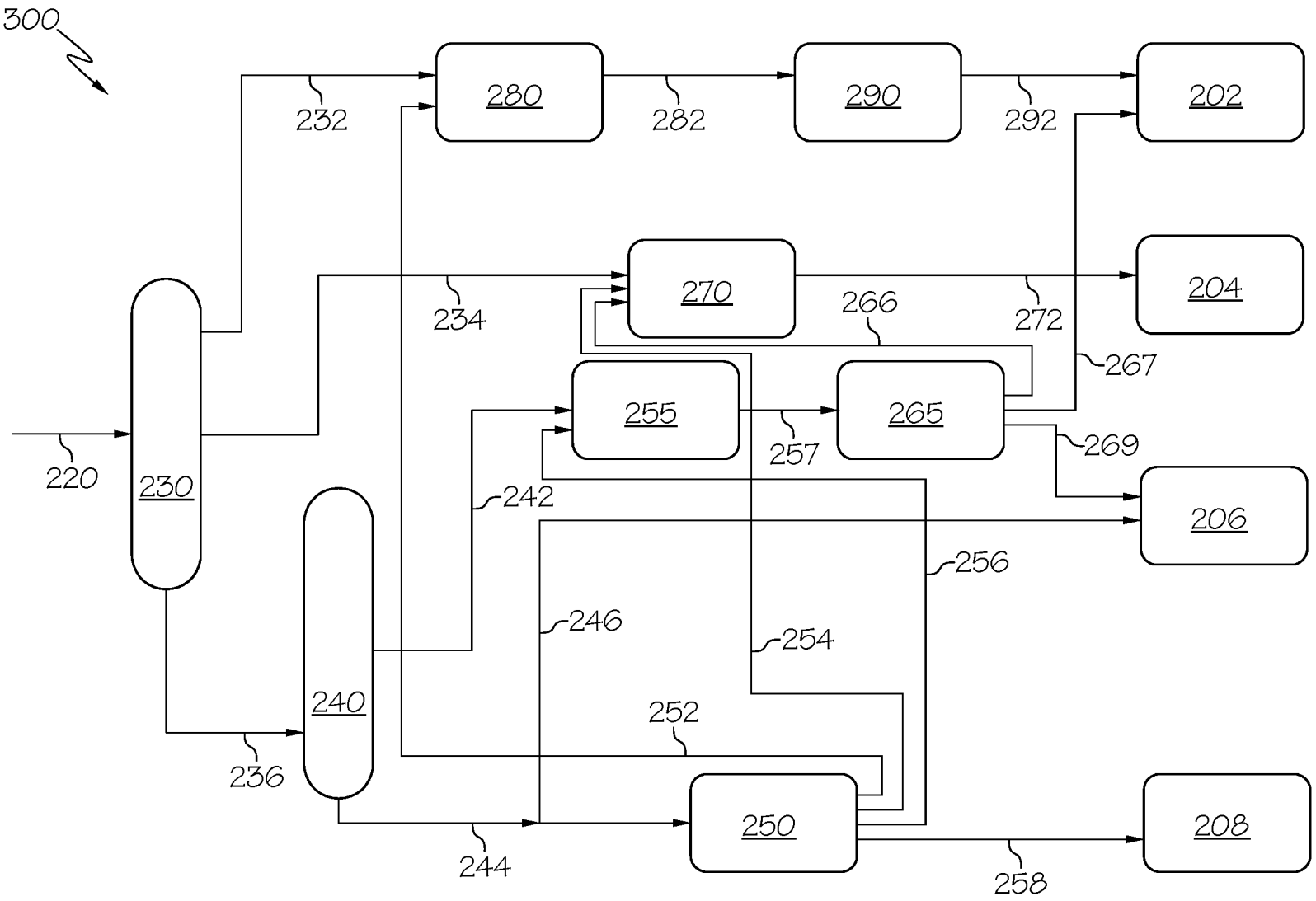
FIG. 3 is a generalized diagram of a chemical processing system utilized subsequent to the chemical pretreatment system of FIG. 1 which includes a fluid catalytic cracking (FCC) unit, according to one or more embodiments described in this disclosure.

For the purpose of the simplified schematic illustrations and descriptions of FIGS. 1-3, the numerous valves, temperature sensors, electronic controllers and the like that may be employed and well known to those of ordinary skill in the art of certain chemical processing operations are not included. Further, accompanying components that are often included in conventional chemical processing operations, such as refineries, such as, for example, air supplies, catalyst hoppers, and flue gas handling are not depicted. It would be known that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process steams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Generally, described in this disclosure are various embodiments of systems and methods for upgrading heavy oils such as crude oil. Such upgrading processes may be a pretreatment step prior to other petrochemical processing such as refining operations utilizing one or more of hydrocracking and fluid catalytic cracking. Generally, the upgrading process may remove one or more of at least a portion of nitrogen, sulfur, and one or more metals from the heavy oil, and may additionally break aromatic moieties in the heavy oil. According to one or more embodiments, the heavy oil may be treated with a hydrodemetalization catalyst (referred to sometimes in this disclosure as an "HDM catalyst"), a transition catalyst, a hydrodenitrogenation catalyst (referred to sometimes in this disclosure as an "HDN catalyst"), and a hydrocracking catalyst. The HDM catalyst, transition catalyst, HDN catalyst, and hydrocracking catalyst may be positioned in series, either contained in a single reactor, such as a packed bed reactor with multiple beds, or contained in two or more reactors arranged in series.

According to one or more embodiments described, the most downstream catalyst of the pretreatment process (that is, the hydrocracking catalyst), may comprise one or more metals on a mesoporous zeolite support. As compared with conventionally utilized hydrocracking catalysts, the hydrocracking catalysts presently described may enhance aromatic cracking, which may cause improved efficiencies in downstream processing such as refining operations. In another embodiment, the HDN catalyst may comprise one or more metals on an alumina support, where the alumina support has an average pore size of from 25 nm to 50 nm. As compared with conventionally utilized HDN catalysts, the HDN catalysts presently described may enhance hydrodenitrogenation, hydrodesulfurization, and cracking of large petrochemical molecules. According to embodiments, the mesoporous zeolite including hydrocracking catalyst may be used in a system with a conventional HDN catalyst, or the 25 nm to 50 nm pore size HDN catalyst may be used in a system with a conventional hydrocracking catalyst. In other embodiments, the mesoporous zeolite including hydrocracking catalyst and the 25 nm to 50 nm pore size HDN catalyst may be utilized in the same system, along with other catalytic beds.

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device that at least partially separates one or more chemicals that are mixed in a process stream from one another. For example, a separation unit may selectively separate differing chemical species from one another, forming one or more chemical fractions. Examples of separation units include, without limitation, distillation columns, flash drums, knock-out drums, knock-out pots, centrifuges, filtration devices, traps, scrubbers, expansion devices, membranes, solvent extraction devices, and the like. It should be understood that separation processes described in this disclosure may not completely separate all of one chemical consistent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided, or separated, into two or more process streams of desired composition. Further, in some separation processes, a "light fraction" and a "heavy fraction" may exit the separation unit, where, in general, the light fraction stream has a lesser boiling point than the heavy fraction stream.

It should be understood that a "reaction effluent" generally refers to a stream that exits a separation unit, a reactor, or reaction zone following a particular reaction or separation, and generally has a different composition than the stream that entered the separation unit, reactor, or reaction zone.

As used in this disclosure, a "catalyst" refers to any substance which increases the rate of a specific chemical reaction. Catalysts described in this disclosure may be utilized to promote various reactions, such as, but not limited to, hydrodemetalization, hydrodesulfurization, hydrodenitrogenation, aromatic cracking, or combinations thereof. As used in this disclosure, "cracking" generally refers to a chemical reaction where a molecule having carbon to carbon bonds is broken into more than one molecule by the breaking of one or more of the carbon to carbon bonds, or is converted from a compound which includes a cyclic moiety, such as an aromatic, to a compound which does not include a cyclic moiety.

It should be understood that two or more process stream are "mixed" or "combined" when two or more lines intersect in the schematic flow diagrams of FIGS. 1-3. Mixing or combining may also include mixing by directly introducing both streams into a like reactor, separation device, or other system component. It should be understood that the reactions that are performed by catalyst as described in this disclosure may remove a chemical constituent, such as only a portion of a chemical constituent, from a process stream. For example, a hydrodemetalization (HDM) catalyst may remove a portion of one or more metals from a process stream, a hydrodenitrogenation (HDN) catalyst may remove a portion of the nitrogen present in a process stream, and a hydrodesulfurization (HDS) catalyst may remove a portion of the sulfur present in a process stream. Additionally, a hydrodearomatization (HDA) catalyst may reduce the amount of aromatic moieties in a process stream by cracking those aromatic moieties. It should be understood that, throughout this disclosure, a particular catalyst is not necessarily limited in functionality to the removal or cracking of a particular chemical constituent or moiety when it is referred to as having a particular functionality. For example, a catalyst identified in this disclosure as an HDN catalyst may additionally provide HDA functionality, HDS functionality, or both.

It should further be understood that streams may be named for the components of the stream, and the component for which the stream is named may be the major component of the stream (such as comprising from 50 weight percent (wt. %), from 70 wt. %, from 90 wt. %, from 95 wt. %, or even from 95 wt. % of the contents of the stream to 100 wt. % of the contents of the stream).

It should be understood that pore size, as used throughout this disclosure, relates to the average pore size unless specified otherwise. The average pore size may be determined from a Brunauer-Emmett-Teller (BET) analysis. Further, the average pore size may be confirmed by transmission electron microscope (TEM) characterization.

Referring now to FIG. 1, a pretreatment system is schematically depicted which includes one or more of an HDM reaction zone 106, a transition reaction zone 108, a HDN reaction zone 110, and a hydrocracking reaction zone 120. According to embodiments of this disclosure, a heavy oil feed stream 101 may be mixed with a hydrogen stream 104. The hydrogen stream 104 may comprise unspent hydrogen gas from recycled process gas component stream 113, make-up hydrogen from hydrogen feed stream 114, or both, to form a pretreatment catalyst input stream 105. In one or more embodiments, pretreatment catalyst input stream 105 may be heated to a process temperature of from 350 degrees Celsius (° C.) to 450° C. The pretreatment catalyst input stream 105 may enter and pass through a series of reaction zones, including the HDM reaction zone 106, the transition reaction zone 108, the HDN reaction zone 110, and a hydrocracking reaction zone 120. The HDM reaction zone 106 comprises an HDM catalyst, the transition reaction zone 108 comprises a transition catalyst, the HDN reaction zone 110 comprises an HDN catalyst, and a hydrocracking reaction zone 120 comprises a hydrocracking catalyst.

The systems and processes described are applicable for a wide variety of heavy oil feeds (in heavy oil feed stream 101), including crude oils, vacuum residue, tar sands, bitumen and vacuum gas oils using a catalytic hydrotreating pretreatment process. If the heavy oil feed is crude oil, it may have an American Petroleum Institute (API) gravity of from 25 degrees to 50 degrees. For example, the heavy oil feed utilized may be Arab Heavy crude oil. The typical properties for an Arab Heavy crude oil are shown in Table 1.

TABLE 1

| Arab Heavy Export Feedstock | | |
|---|---|---|
| | Units | Value |
| Analysis | | |
| American Petroleum Institute (API) gravity | degree | 27 |
| Density | grams per cubic centimeter ($g/cm^3$) | 0.8904 |
| Sulfur Content | Weight percent (wt. %) | 2.83 |
| Nickel | Parts per million by weight (ppmw) | 16.4 |
| Vanadium | ppmw | 56.4 |
| NaCl Content | ppmw | <5 |
| Conradson Carbon Residue (CCR) | wt. % | 8.2 |
| C5 Asphaltenes | wt. % | 7.8 |
| C7 Asphaltenes | wt. % | 4.2 |

Referring still to FIG. 1, pretreatment catalyst input stream 105 may be introduced to pretreatment reactor 130. According to one or more embodiments, the pretreatment reactor 130 may comprise multiple reactions zones arranged in series (for example, the HDM reaction zone 106, the transition reaction zone 108, the HDN reaction zone 110, and a hydrocracking reaction zone 120) and each of these reaction zones may comprise a catalyst bed. In such an embodiment, the pretreatment reactor 130 comprises an HDM catalyst bed comprising an HDM catalyst in the HDM reaction zone 106, a transition catalyst bed comprising a transition catalyst in the transition reaction zone 108, an HDN catalyst bed comprising an HDN catalyst in the HDN reaction zone 110, and a hydrocracking catalyst bed comprising a hydrocracking catalyst in the hydrocracking reaction zone 120.

According to one or more embodiments, the pretreatment catalyst input stream 105, which comprises heavy oil, is introduced to the HDM reaction zone 106 and is contacted by the HDM catalyst. Contact by the HDM catalyst with the pretreatment catalyst input stream 105 may remove at least a portion of the metals present in the pretreatment catalyst input stream 105. Following contact with the HDM catalyst, the pretreatment catalyst input stream 105 may be converted to an HDM reaction effluent. The HDM reaction effluent may have a reduced metal content as compared to the contents of the pretreatment catalyst input stream 105. For example, the HDM reaction effluent may have at least 70 wt. % less, at least 80 wt. % less, or even at least 90 wt. % less metal as the pretreatment catalyst input stream 105.

According to one or more embodiments, the HDM reaction zone 106 may have a weighted average bed temperature of from 350° C. to 450° C., such as from 370° C. to 415° C., and may have a pressure of from 30 bars to 200 bars, such as from 90 bars to 110 bars. The HDM reaction zone 106 comprises the HDM catalyst, and the HDM catalyst may fill the entirety of the HDM reaction zone 106.

The HDM catalyst may comprise one or more metals from the International Union of Pure and Applied Chemistry (IUPAC) Groups 5, 6, or 8-10 of the periodic table. For example, the HDM catalyst may comprise molybdenum. The HDM catalyst may further comprise a support material, and the metal may be disposed on the support material. In one embodiment, the HDM catalyst may comprise a molybdenum metal catalyst on an alumina support (sometimes referred to as "Mo/$Al_2O_3$ catalyst"). It should be understood throughout this disclosure that metals that are contained in any of the disclosed catalysts may be present as sulfides or oxides, or even other compounds.

In one embodiment, the HDM catalyst may include a metal sulfide on a support material, where the metal is selected from the group consisting of IUPAC Groups 5, 6, and 8-10 elements of the periodic table, and combinations thereof. The support material may be gamma-alumina or silica/alumina extrudates, spheres, cylinders, beads, pellets, and combinations thereof.

In one embodiment, the HDM catalyst may comprise a gamma-alumina support, with a surface area of from 100 $m^2/g$ to 160 $m^2/g$ (such as, from 100 $m^2/g$ to 130 $m^2/g$, or form 130 $m^2/g$ to 160 $m^2/g$). The HDM catalyst can be best described as having a relatively large pore volume, such as at least 0.8 $cm^3/g$ (for example, at least 0.9 $cm^3/g$, or even at least 1.0 $cm^3/g$. The pore size of the HDM catalyst may be predominantly macroporous (that is, having a pore size of greater than 50 nm). This may provide a large capacity for the uptake of metals on the HDM catalyst's surface and optionally dopants. In one embodiment, a dopant can be selected from the group consisting of boron, silicon, halogens, phosphorus, and combinations thereof.

In one or more embodiments, the HDM catalyst may comprise from 0.5 wt. % to 12 wt. % of an oxide or sulfide of molybdenum (such as from 2 wt. % to 10 wt. % or from 3 wt. % to 7 wt. % of an oxide or sulfide of molybdenum), and from 88 wt. % to 99.5 wt. % of alumina (such as from 90 wt. % to 98 wt. % or from 93 wt. % to 97 wt. % of alumina).

Without being bound by theory, in some embodiments, it is believe that during the reaction in the HDM reaction zone 106, porphyrin type compounds present in the heavy oil are first hydrogenated by the catalyst using hydrogen to create an intermediate. Following this primary hydrogenation, the nickel or vanadium present in the center of the porphyrin molecule is reduced with hydrogen and then further reduced to the corresponding sulfide with hydrogen sulfide ($H_2S$). The final metal sulfide is deposited on the catalyst thus removing the metal sulfide from the virgin crude oil. Sulfur is also removed from sulfur containing organic compounds. This is performed through a parallel pathway. The rates of these parallel reactions may depend upon the sulfur species being considered. Overall, hydrogen is used to abstract the sulfur which is converted to $H_2S$ in the process. The remaining, sulfur-free hydrocarbon fragment remains in the liquid hydrocarbon stream.

The HDM reaction effluent may be passed from the HDM reaction zone 106 to the transition reaction zone 108 where it is contacted by the transition catalyst. Contact by the transition catalyst with the HDM reaction effluent may remove at least a portion of the metals present in the HDM reaction effluent stream as well as may remove at least a portion of the nitrogen present in the HDM reaction effluent stream. Following contact with the transition catalyst, the HDM reaction effluent is converted to a transition reaction effluent. The transition reaction effluent may have a reduced metal content and nitrogen content as compared to the HDM reaction effluent. For example, the transition reaction effluent may have at least 1 wt. % less, at least 3 wt. % less, or even at least 5 wt. % less metal content as the HDM reaction effluent. Additionally, the transition reaction effluent may have at least 10 wt. % less, at least 15 wt. % less, or even at least 20 wt. % less nitrogen as the HDM reaction effluent.

According to embodiments, the transition reaction zone 108 has a weighted average bed temperature of about 370° C. to 410° C. The transition reaction zone 108 comprises the transition catalyst, and the transition catalyst may fill the entirety of the transition reaction zone 108.

In one embodiment, the transition reaction zone 108 may be operable to remove a quantity of metal components and a quantity of sulfur components from the HDM reaction effluent stream. The transition catalyst may comprise an alumina based support in the form of extrudates.

In one embodiment, the transition catalyst comprises one metal from IUPAC Group 6 and one metal from IUPAC Groups 8-10. Example IUPAC Group 6 metals include molybdenum and tungsten. Example IUPAC Group 8-10 metals include nickel and cobalt. For example, the transition catalyst may comprise Mo and Ni on a titania support (sometimes referred to as "Mo—Ni/$Al_2O_3$ catalyst"). The transition catalyst may also contain a dopant that is selected from the group consisting of boron, phosphorus, halogens, silicon, and combinations thereof. The transition catalyst can have a surface area of 140 $m^2/g$ to 200 $m^2/g$ (such as from 140 $m^2/g$ to 170 $m^2/g$ or from 170 $m^2/g$ to 200 $m^2/g$). The transition catalyst can have an intermediate pore volume of from 0.5 $cm^3/g$ to 0.7 $cm^3/g$ (such as 0.6 $cm^3/g$). The transition catalyst may generally comprise a mesoporous structure having pore sizes in the range of 12 nm to 50 nm. These characteristics provide a balanced activity in HDM and HDS.

In one or more embodiments, the transition catalyst may comprise from 10 wt. % to 18 wt. % of an oxide or sulfide of molybdenum (such as from 11 wt. % to 17 wt. % or from 12 wt. % to 16 wt. % of an oxide or sulfide of molybdenum), from 1 wt. % to 7 wt. % of an oxide or sulfide of nickel (such as from 2 wt. % to 6 wt. % or from 3 wt. % to 5 wt. % of an oxide or sulfide of nickel), and from 75 wt. % to 89 wt. % of alumina (such as from 77 wt. % to 87 wt. % or from 79 wt. % to 85 wt. % of alumina).

The transition reaction effluent may be passed from the transition reaction zone 108 to the HDN reaction zone 110 where it is contacted by the HDN catalyst. Contact by the HDN catalyst with the transition reaction effluent may remove at least a portion of the nitrogen present in the transition reaction effluent stream. Following contact with the HDN catalyst, the transition reaction effluent may be converted to an HDN reaction effluent. The HDN reaction effluent may have a reduced metal content and nitrogen content as compared to the transition reaction effluent. For example, the HDN reaction effluent may have a nitrogen content reduction of at least 80 wt. %, at least 85 wt. %, or even at least 90 wt. % relative to the transition reaction effluent. In another embodiment, the HDN reaction effluent may have a sulfur content reduction of at least 80 wt. %, at least 90 wt. %, or even at least 95 wt. % relative to the transition reaction effluent. In another embodiment, the HDN reaction effluent may have an aromatics content reduction of at least 25 wt. %, at least 30 wt. %, or even at least 40 wt. % relative to the transition reaction effluent.

According to embodiments, the HDN reaction zone 110 has a weighted average bed temperature of from 370° C. to 410° C. The HDN reaction zone 110 comprises the HDN catalyst, and the HDN catalyst may fill the entirety of the HDN reaction zone 110.

In one embodiment, the HDN catalyst includes a metal oxide or sulfide on a support material, where the metal is selected from the group consisting of IUPAC Groups 5, 6, and 8-10 of the periodic table, and combinations thereof. The support material may include gamma-alumina, meso-porous alumina, silica, or both, in the form of extrudates, spheres, cylinders and pellets.

According to one embodiment, the HDN catalyst contains a gamma alumina based support that has a surface area of 180 $m^2/g$ to 240 $m^2/g$ (such as from 180 $m^2/g$ to 210 $m^2/g$, or from 210 $m^2/g$ to 240 $m^2/g$). This relatively large surface area for the HDN catalyst allows for a smaller pore volume (for example, less than 1.0 $cm^3/g$, less than 0.95 $cm^3/g$, or even less than 0.9 $cm^3/g$). In one embodiment, the HDN catalyst contains at least one metal from IUPAC Group 6, such as molybdenum and at least one metal from IUPAC Groups 8-10, such as nickel. The HDN catalyst can also include at least one dopant selected from the group consisting of boron, phosphorus, silicon, halogens, and combinations thereof. In one embodiment, cobalt can be used to increase desulfurization of the HDN catalyst. In one embodiment, the HDN catalyst has a higher metals loading for the active phase as compared to the HDM catalyst. This increased metals loading may cause increased catalytic activity. In one embodiment, the HDN catalyst comprises nickel and molybdenum, and has a nickel to molybdenum mole ratio (Ni/(Ni+Mo)) of 0.1 to 0.3 (such as from 0.1 to 0.2 or from 0.2 to 0.3). In an embodiment that includes cobalt, the mole ratio of (Co+Ni)/Mo may be in the range of 0.25 to 0.85 (such as from 0.25 to 0.5 or from 0.5 to 0.85).

According to another embodiment, the HDN catalyst may contain a mesoporous material, such as mesoporous alumina, that may have an average pore size of at least 25 nm. For example, the HDN catalyst may comprise mesoporous alumina having an average pore size of at least 30 nm, or even at least 35 nm. HDN catalysts with relatively small average pore size, such as less than 25 nm, may be referred to as conventional HDN catalysts in this disclosure, and may have relatively poor catalytic performance as compared with the larger pore-sized HDN catalysts presently disclosed. Embodiments of HDN catalysts which have an alumina support having an average pore size of from 2 nm to 50 nm may be referred to in this disclosure as "meso-porous alumina supported catalysts." In one or more embodiments, the mesoporous alumina of the HDM catalyst may have an average pore size in a range from 25 nm to 50 nm, from 30 nm to 50 nm, or from 35 nm to 50 nm. According to embodiments, the HDN catalyst may include alumina that has a relatively large surface area, a relatively large pore volume, or both. For example, the mesoporous alumina may have a relatively large surface area by having a surface area of at least about 225 $m^2/g$, at least about 250 $m^2/g$, at least about 275 $m^2/g$, at least about 300 $m^2/g$, or even at least about 350 $m^2/g$, such as from 225 $m^2/g$ to 500 $m^2/g$, from 200 $m^2/g$ to 450 $m^2/g$, or from 300 $m^2/g$ to 400 $m^2/g$. In one or more embodiments, the mesoporous alumina may have a relatively large pore volume by having a pore volume of at least about 1 mL/g, at least about 1.1 mL/g, at least 1.2 mL/g, or even at least 1.2 mL/g, such as from 1 mL/g to 5 mL/g, from 1.1 mL/g to 3, or from 1.2 mL/g to 2 mL/g. Without being bound by theory, it is believed that the meso-porous alumina supported HDN catalyst may provide additional active sites and a larger pore channels that may facilitate larger molecules to be transferred into and out of the catalyst. The additional active sites and larger pore channels may result in higher catalytic activity, longer catalyst life, or both. In one embodiment, a dopant can be selected from the group consisting of boron, silicon, halogens, phosphorus, and combinations thereof.

According to embodiments described, the HDN catalyst may be produced by mixing a support material, such as alumina, with a binder, such as acid peptized alumina. Water or another solvent may be added to the mixture of support material and binder to form an extrudable phase, which is then extruded into a desired shape. The extrudate may be dried at an elevated temperature (such as above 100° C., such as 110° C.) and then calcined at a suitable temperature (such as at a temperature of at least 400° C., at least 450° C., such as 500° C.). The calcined extrudates may be impregnated with an aqueous solution containing catalyst precursor materials, such as precursor materials which include Mo, Ni, or combinations thereof. For example, the aqueous solution may contain ammonium heptanmolybdate, nickel nitrate, and phosphoric acid to form an HDN catalyst comprising compounds comprising molybdenum, nickel, and phosphorous.

In embodiments where a meso-porous alumina support is utilized, the meso-porous alumina may be synthesized by dispersing boehmite powder in water at 60° C. to 90° C. Then, an acid such as $HNO_3$ may be added to the boehmite is water solution at a ratio of $HNO_3$:$Al^{3+}$ of 0.3 to 3.0 and the solution is stirred at 60° C. to 90° C. for several hours, such as 6 hours, to obtain a sol. A copolymer, such as a triblock copolymer, may be added to the sol at room temperature, where the molar ratio of copolymer:Al is from 0.02 to 0.05 and aged for several hours, such as three hours. The sol/copolymer mixture is dried for several hours and then calcined.

According to one or more embodiments, the HDN catalyst may comprise from 10 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 74 wt. % to 88 wt. % of alumina (such as from 76 wt. % to 84 wt. % or from 78 wt. % to 82 wt. % of alumina).

In a similar manner to the HDM catalyst, and again not intending to be bound to any theory, it is believed that hydrodenitrogenation and hydrodearomatization may operate via related reaction mechanisms. Both involve some degree of hydrogenation. For the hydrodenitrogenation, organic nitrogen compounds are usually in the form of heterocyclic structures, the heteroatom being nitrogen. These heterocyclic structures may be saturated prior to the removal of the heteroatom of nitrogen. Similarly, hydrodearomatization involves the saturation of aromatic rings. Each of these reactions may occur to a differing amount on each of the catalyst types as the catalysts are selective to favor one type of transfer over others and as the transfers are competing.

It should be understood that some embodiments of the presently described methods and systems may utilize HDN catalyst that include porous alumina having an average pore size of at least 25 nm. However, in other embodiments, the average pore size of the porous alumina may be less than about 25 nm, and may even be microporous (that is, having an average pore size of less than 2 nm).

Still referring to FIG. 1, the HDN reaction effluent may be passed from the HDN reaction zone 110 to the hydrocracking reaction zone 120 where it is contacted by the hydrocracking catalyst. Contact by the hydrocracking catalyst with the HDN reaction effluent may reduce aromatic content present in the HDN reaction effluent. Following contact with the hydrocracking catalyst, the HDN reaction effluent is converted to a pretreatment catalyst reaction effluent stream 109. The pretreatment catalyst reaction effluent stream 109 may have reduced aromatics content as compared to the HDN reaction effluent. For example, the pretreatment catalyst reaction effluent stream 109 may have at least 50 wt. % less, at least 60 wt. % less, or even at least 80 wt. % less aromatics content as the HDN reaction effluent.

The hydrocracking catalyst may comprise one or more metals from IUPAC Groups 5, 6, 8, 9, or 10 of the periodic table. For example, the hydrocracking catalyst may comprise one or more metals from IUPAC Groups 5 or 6, and one or more metals from IUPAC Groups 8, 9, or 10 of the periodic table. For example, the hydrocracking catalyst may comprise molybdenum or tungsten from IUPAC Group 6 and nickel or cobalt from IUPAC Groups 8, 9, or 10. The HDM catalyst may further comprise a support material, and the metal may be disposed on the support material, such as a zeolite. In one embodiment, the hydrocracking catalyst may comprise tungsten and nickel metal catalyst on a zeolite support that is mesoporous (sometimes referred to as "W—Ni/meso-zeolite catalyst"). In another embodiment, the hydrocracking catalyst may comprise molybdenum and nickel metal catalyst on a zeolite support that is mesoporous (sometimes referred to as "Mo—Ni/meso-zeolite catalyst").

According to embodiments of the hydrocracking catalysts of the catalytic systems described in this disclosure, the support material (that is, the mesoporous zeolite) may be characterized as mesoporous by having average pore size of from 2 nm to 50 nm. By way of comparison, conventional zeolite-based hydrocracking catalysts contain zeolites which are microporous, meaning that they have an average pore size of less than 2 nm. Without being bound they theory, it is believed that the relatively large pore sized (that is, mesoporosity) of the presently described hydrocracking catalysts allows for larger molecules to diffuse inside the zeolite, which is believed to enhance the reaction activity and selectivity of the catalyst. With the increased pore size, aromatic containing molecules can more easily diffuse into the catalyst and aromatic cracking may be increased. For example, in some conventional embodiments, the feedstock converted by the hydroprocessing catalysts may be vacuum gas oils, light cycle oils from, for example, a fluid catalytic cracking reactor, or coker gas oils from, for example, a coking unit. The molecular sizes in these oils are relatively small relative to those of heavy oils such as crude and atmosphere residue, which may be the feedstock of the present methods and systems. The heavy oils generally are not able to diffuse inside the conventional zeolites and be converted on the active sites located inside the zeolites. Therefore, zeolites with larger pore sizes (that is, mesoporous zeolites) may make the larger molecules of heavy oils overcome the diffusion limitation, and may make possible reaction and conversion of the larger molecules of the heavy oils.

The zeolite support material is not necessarily limited to a particular type of zeolite. However, it is contemplated that zeolites such as Y, Beta, AWLZ-15, LZ-45, Y-82, Y-84, LZ-210, LZ-25, Silicalite, or mordenite may be suitable for use in the presently described hydrocracking catalyst. For example, suitable mesoporous zeolites which can be impregnated with one or more catalytic metals such as W, Ni, Mo, or combinations thereof, are described in at least U.S. Pat. No. 7,785,563; Zhang et al., Powder Technology 183 (2008) 73-78; Liu et al., Microporous and Mesoporous Materials 181 (2013) 116-122; and Garcia-Martinez et al., Catalysis Science & Technology, 2012 (DOI: 10.1039/c2cy00309k).

In one or more embodiments, the hydrocracking catalyst may comprise from 18 wt. % to 28 wt. % of a sulfide or oxide of tungsten (such as from 20 wt. % to 27 wt. % or from 22 wt. % to 26 wt. % of tungsten or a sulfide or oxide of tungsten), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of mesoporous zeolite (such as from 10 wt. % to 35 wt. % or from 10 wt. % to 30 wt. % of zeolite). In another embodiment, the hydrocracking catalyst may comprise from 12 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of mesoporous zeolite (such as from 10 wt. % to 35 wt. % or from 10 wt. % to 30 wt. % of mesoporous zeolite).

The hydrocracking catalysts described may be fabricated by selecting a mesoporous zeolite and impregnating the mesoporous zeolite with one or more catalytic metals or by comulling mesoporous zeolite with other components. For the impregnation method, the mesoporous zeolite, active alumina (for example, boehmite alumina), and binder (for example, acid peptized alumina) may be mixed. An appropriate amount of water may be added to form a dough that can be extruded using an extruder. The extrudate may be dried at 80° C. to 120° C. for 4 hours to 10 hours, and then calcinated at 500° C. to 550° C. for 4 hours to 6 hours. The calcinated extrudate may be impregnated with an aqueous solution prepared by the compounds comprising Ni, W, Mo, Co, or combinations thereof. Two or more metal catalyst precursors may be utilized when two metal catalysts are desired. However, some embodiments may include only one of Ni, W, Mo, or Co. For example, the catalyst support material may be impregnated by a mixture of nickel nitrate hexahydrate (that is, $Ni(NO_3)2.6H_2O$) and ammonium metatungstate (that is, $(NH_4)6H_2W_{12}O_{40}$) if a W—Ni catalyst is desired. The impregnated extrudate may be dried at 80° C. to 120° C. for 4 hours to 10 hours, and then calcinated at 450° C. to 500° C. for 4 hours to 6 hours. For the comulling method, the mesoporous zeolite may be mixed with alumina, binder, and the compounds comprising W or Mo, Ni or Co (for example $MoO_3$ or nickel nitrate hexahydrate if Mo—Ni is desired).

It should be understood that some embodiments of the presently described methods and systems may utilize a hydrocracking catalyst that includes a mesoporous zeolite (that is, having an average pore size of from 2 nm to 50 nm). However, in other embodiments, the average pore size of the zeolite may be less than 2 nm (that is, microporous).

According to one or more embodiments described, the volumetric ratio of HDM catalyst:transition catalyst:HDN catalyst:hydrocracking catalyst may be 5-20:5-30:30-70:5-30 (such as a volumetric ratio of 5-15:5-15:50-60:15-20, or approximately 10:10:60:20.) The ratio of catalysts may depend at least partially on the metal content in the oil feedstock processed.

Still referring to FIG. 1, pretreatment catalyst reaction effluent stream 109 may enter a separation unit 112 and may be separated into recycled process gas component stream 113 and intermediate liquid product stream 115. In one embodiment, the pretreatment catalyst reaction effluent stream 109 may also be purified to remove hydrogen sulfide and other process gases to increase the purity of the hydrogen to be recycled in recycled process gas component stream 113. The hydrogen consumed in the process can be compensated for by the addition of a fresh hydrogen from hydrogen feed stream 114, which may be derived from a steam or naphtha reformer or other source. Recycled process gas component stream 113 and fresh make-up hydrogen feed stream 114 may combine to form hydrogen stream 104. In one embodiment, intermediate liquid product stream 115 from the process can be flashed in flash vessel 116 to separate light hydrocarbon fraction stream 117 and pretreatment final liquid product stream 118; however, it should be understood that this flashing step is optional. In one embodiment, light hydrocarbon fraction stream 117 acts as a recycle and is mixed with fresh light hydrocarbon diluent stream 102 to create light hydrocarbon diluent stream 103. Fresh light hydrocarbon diluent stream 102 can be used to provide make-up diluent to the process as needed in order to help further reduce the deactivation of one or more of the catalysts in the pretreatment reactor 130.

In one or more embodiments, one or more of the pretreatment catalyst reaction effluent stream 109, the intermediate liquid product stream 115, and the pretreatment final liquid product stream 118 may have reduced aromatic content as compared with the heavy oil feed stream 101. Additionally, in embodiments, one or more of the pretreatment catalyst reaction effluent stream 109, the intermediate liquid product stream 115, and the pretreatment final liquid product stream 118 may have significantly reduced sulfur, metal, asphaltenes, Conradson carbon, nitrogen content, or combinations thereof, as well as an increased API and increased diesel and vacuum distillate yields in comparison with the heavy oil feed stream 101.

According to one embodiment, the pretreatment catalyst reaction effluent stream 109 may have a reduction of at least about 80 wt. %, a reduction of at least 90 wt. %, or even a reduction of at least 95 wt. % of nitrogen with respect to the heavy oil feed stream 101. According to another embodiment, the pretreatment catalyst reaction effluent stream 109 may have a reduction of at least about 85 wt. %, a reduction of at least 90 wt. %, or even a reduction of at least 99 wt. % of sulfur with respect to the heavy oil feed stream 101. According to another embodiment, the pretreatment catalyst reaction effluent stream 109 may have a reduction of at least about 70 wt. %, a reduction of at least 80 wt. %, or even a reduction of at least 85 wt. % of aromatic content with respect to the heavy oil feed stream 101. According to another embodiment, the pretreatment catalyst reaction effluent stream 109 may have a reduction of at least about 80 wt. %, a reduction of at least 90 wt. %, or even a reduction of at least 99 wt. % of metal with respect to the heavy oil feed stream 101.

Still referring to FIG. 1, in various embodiments, one or more of the pretreatment catalyst reaction effluent stream 109, the intermediate liquid product stream 115, and the pretreatment final liquid product stream 118 may be suitable for use as the upgraded fuel stream 220 of a refining process such as shown in FIG. 2 or 3, as described subsequently in this disclosure. As used in this disclosure, one or more of the pretreatment catalyst reaction effluent stream 109, the intermediate liquid product stream 115, and the pretreatment final liquid product stream 118 may be referred to as an "upgraded fuel" which may be downstream processed by refining as described with reference to FIGS. 2 and 3.

In embodiments of the described systems and processes, an upgraded fuel stream 220 may be used as a feedstock or as part of a feedstock for a downstream chemical processing system, such as a coking refinery 200 with a hydrocracking process unit as shown in FIG. 2 or a coking refinery 300 with an fluid catalytic cracking (FCC) conversion unit as shown in FIG. 3. In such embodiments, the upgraded fuel stream 220 is processed to form one or more petrochemical fractions (such as, for example, gasoline, distillate fuel, fuel oil, or coke) by a hydrocracking process or a FCC process. In the case of upgraded fuel stream 220 being used as part of a feedstock, the balance of the feedstock can be crude not derived from the pretreatment step described with reference to FIG. 1. A simplified schematic of an example coking refinery is depicted in FIG. 2. While embodiments of downstream processing systems are described in this disclosure with reference to FIGS. 2 and 3, it should be understood that these downstream processes are not limiting on the pretreatment, upgrading process described with reference to FIG. 1.

FIG. 2 represents a first embodiment of a delayed coking refinery 200 having a coking refinery with a hydrocracking process unit. In FIG. 2, upgraded fuel stream 220, which may comprise either intermediate liquid product stream 115 or pretreatment final liquid product stream 118 from FIG. 1, enters atmospheric distillation column 230, where it may be separated into at least, but not limited to three fractions. The three fractions may include a straight run naphtha stream 232, an atmospheric gas oil stream 234, and an atmospheric residue stream 236. In an additional embodiment, virgin crude oil can be added along with upgraded fuel stream 220 as a feedstock for the delayed coking refineries 200, 300 of FIGS. 2 and 3.

Atmospheric residue stream 236 may enter vacuum distillation column 240, where the atmospheric residue stream 236 may be separated into a vacuum gas oil stream 242 and a vacuum residue stream 244. In the embodiment shown in FIG. 2, slipstream 246 may be removed from vacuum residue stream 244 and sent to fuel oil collection tank 206. The remainder of vacuum residue stream 244 may enter delayed coking process unit 250, where vacuum residue stream 244 may be processed to create coker naphtha stream 252, coker gas oil stream 254, heavy coker gas oil stream 256, and green coke stream 258, with green coke stream 258 being then sent to coke collection tank 208. Green coke, as used in this disclosure, is another name for a greater quality coke. Coupled with the lower coke yield, a greater liquid yield may be observed resulting in greater amounts of coker gas oil stream 254 and heavy coker gas oil stream 256. Coker gas oil stream 254 in the disclosed systems and methods may be fed to gas oil hydrotreater 270. According to some embodiments, coker gas oil stream 254 may have a relatively large amount of unsaturated content, particularly olefins, which may deactivate downstream HDN catalyst. An increased yield of this stream would normally constrain gas oil hydrotreater 270 catalyst cycle length. However, in embodiments of the disclosed systems and methods, this increased feed to gas oil hydrotreater 270 can be processed due to the improved properties of atmospheric gas oil stream 234 (that is, lesser sulfur and aromatics in the feed).

Still referring to FIG. 2, coker gas oil stream 254 along with atmospheric gas oil stream 234 may be sent to gas oil hydrotreater 270 in order to further remove impurities. According to some embodiments, coker gas oil stream 254 and ATM gas oil stream 234 have large amounts of unsaturated content, particularly olefins which can deactivate downstream HDN catalysts. An increased yield of these streams may normally constrain gas oil hydrotreater 270 catalyst cycle length. However, in accordance with an embodiment of the disclosed systems and methods, the increased feed to gas oil hydrotreater 270 can be processed due to the improved properties of ATM gas oil stream 234 and coker gas oil stream 254. Distillate fuel stream 272 exits gas oil hydrotreater 270 is are introduced into distillate fuel collection tank 204.

The coker naphtha stream 252, along with the straight run naphtha stream 232, is sent to naphtha hydrotreater 280. Due to the fact that coker naphtha stream 252 and straight run naphtha stream 232 have lesser amounts of sulfur and aromatics than they would normally contain absent the pretreatment steps described with reference to in FIG. 1, naphtha hydrotreater 280 may not have to perform as much hydrodesulfurization as it would normally require, which allows for increased throughputs and ultimately greater yields of gasoline fractions.

Another advantage of an embodiment of the disclosed systems and methods, which further enables the increase in throughput in delayed coking process unit 250, is the fact that ATM gas oil stream 234 may have significantly lesser sulfur content.

Vacuum gas oil stream 242 along with heavy coker gas oil stream 256 may be sent to hydrocracker 260 for upgrading to form a hydrocracked naphtha stream 262 and a hydrocracked middle distillate stream 264, with hydrocracked middle distillate stream 264 being fed, along with distillate fuel stream 272, to distillate fuel collection tank 204.

Hydrotreated naphtha stream 282 and hydrocracked naphtha stream 262 are introduced to naphtha reformer 290, where hydrotreated naphtha stream 282 and hydrocracked naphtha stream 262 may be converted from low octane fuels into high-octane liquid products known as gasoline 292. It is believed that naphtha reformer 290 may re-arrange or restructure the hydrocarbon molecules in the naphtha feedstocks as well as break some of the molecules into lesser molecules. The overall effect may be that the product reformate contains hydrocarbons with more complex molecular shapes having greater octane values than the hydrocarbons in the naphtha feedstocks. In so doing, the naphtha reformer 290 separates hydrogen atoms from the hydrocarbon molecules and produces very significant amounts of byproduct hydrogen gas for use as make-up hydrogen feed stream 114 of FIG. 1.

A conventionally operated coking refinery would be limited in throughput by delayed coking process unit 250. The maximum throughput of the refinery would therefore also be limited by the maximum amount of throughput possible through delayed coking process unit 250. However, the disclosed pretreatment systems and methods advantageously enable the processing of an increased amount of heavy oil through the refinery with surprisingly improved results.

If, as in the case of the disclosed systems and methods, an upgrade heavy oil may be processed in the refinery configuration as shown in FIG. 2, the reduction of at least sulfur and aromatics content will cause the performance of the downstream process to be advantageously affected.

In embodiments in which the upgraded heavy oil is combined with untreated crude oil as a feedstock for subsequent refining processes (not shown), for example a delayed coking facility having a delayed coking process unit, the delayed coking process unit can run at essentially the same coke handling capacity it was designed for originally, but with improved yields in all of the liquid products and enhancement of the petroleum coke quality (lower sulfur and metals). One of the positive impacts on delayed coking process unit 250 is that the feed stream will have less metals, carbon and sulfur, since the upgraded crude oil acts like a diluent. The impact of less sulfur will mean that the final coke product will be of a greater grade, resulting in increases of green coke stream 258.

A second refinery embodiment 300 comprising a coking refinery with an FCC conversion unit, which utilizes the same bottoms conversion but having different Vacuum Gas Oil conversion, can be seen in FIG. 3. In this embodiment, upgraded fuel stream 220 may be fed to this refinery just as in FIG. 2. The embodiments of FIGS. 2 and 3 are highly similar except that they differ primarily in that FIG. 3 uses a combination of VGO hydrotreater 255 and FCC unit 265 in place of a hydrocracker. As was described with reference to the process depicted in FIG. 2, the pretreated processing of upgraded fuel stream 220 will impact many or all of the process units within the refinery configuration of FIG. 3. Analogous benefits may be seen with delayed coking process unit 250 as for the previous example, such as the increased liquid yield and lower coke production. As discussed previously, this will enable a greater throughput through delayed coking process unit 250, enabling a greater throughput through the refinery. In addition, there may be an increased capacity for further processing coker gas oil stream 254 in gas oil hydrotreater 270, due to the lower sulfur content of coker gas oil stream 254 and its impact on the reduced HDS requirement from gas oil hydrotreater 270.

As depicted in FIG. 3, desulfurized vacuum gas oil stream 257 [from the VGO hydrotreater 255] may be introduced to FCC unit 265, where it may be hydrocracked to produce multiple streams. These streams may include a light cycle oil stream 266, FCC gasoline stream 267, and a heavy cycle oil stream 269. Light cycle oil stream 266 may be combined with ATM gas oil stream 234 and coker gas oil stream 254 in gas oil hydrotreater 270 to form distillate fuel stream 272. Heavy cycle oil stream 269 may be combined with slipstream 246 at fuel oil collection tank 206. FCC gasoline stream 267 may be joined by gasoline stream 292 at gasoline pool collection tank 202.

EXAMPLES

The various embodiments of methods and systems for the upgrading of a heavy fuel will be further clarified by the following examples. The examples are illustrative in nature, and should not be understood to limit the subject matter of the present disclosure.

Example 1—Preparation of Mesoporous Hydrocracking Catalyst

A hydrocracking catalyst comprising mesoporous zeolite as described previously in this disclosure was synthesized. 74.0 g of commercial NaY zeolite (commercially available as CBV-100 from Zeolyst) was added in 400 milliliters (mL) of 3 molar (M) sodium hydroxide (NaOH) solution, stirred at 100° C. for 12 hours. Then, 60.0 g of cetyl trimethylammonium bromide (CTAB) was added into prepared mixture while the acidity was controlled at 10 pH with 3 M hydrochloric acid solution. The mixture was aged at 80° C. for 9 hours, and then transferred into a Teflon-lined stainless steel autoclave and crystallized at 100° C. for 24 hours. Following the crystallization, the sample was washed with deionized water, dried at 110° C. for 12 hours, and calcined at 550° C. for 6 hours. The as-made sample was ion-exchanged with 2.5 M ammonium nitrate ($NH_4NO_3$) solution at 90° C. for 2 hours, followed by a steam treatment (at a flow rate of 1 milliliter per minute (mL/min)) at 500° C. for 1 hour. Then, the sample was ion-exchanged with 2.5 M $NH_4NO_3$ solution again. Finally, the sample was dried at 100° C. for 12 hours and calcined at 550° C. for 4 hours to form a mesoporous zeolite Y. In a mortar, 34 grams (g) of the mesoporous zeolite Y, 15 g of molybdenum trioxide ($MoO_3$), 20 g of nickel(II) nitrate hexahydrate ($Ni(NO_3)_2 6H_2O$), and 30.9 g of alumina (commercially available as PURALOX® HP 14/150 from Sasol) were mixed evenly. Then, 98.6 g of binder made from alumina (commercially available as CATAPAL® from Sasol) and diluted nitric acid ($HNO_3$) (ignition of loss: 70 wt. %) was added, which pasted the mixture to form a dough by adding an appropriate amount of water. The dough was extruded with an extruder to form a cylindered extrudate. The extrudate was dried at 110° C. overnight, and calcinated at 500° C. for 4 hours.

Example 2—Preparation of Conventional Hydrocracking Catalyst

A conventional hydrocracking catalyst (including a microporous zeolite) was produced by a method similar to that of Example 1 which utilized a commercial microporous zeolite. In a mortar, 34 g of microporous zeolite (commercially available as ZEOLYST® CBV-600 from Micrometrics), 15 g of $MoO_3$, 20 g of $Ni(NO_3)_2 6H_2O$, and 30.9 g of alumina (commercially available as PURALOX® HP 14/150 from Sasol) were mixed evenly. Then, 98.6 g of binder made from boehmite alumina (commercially available as CATAPAL® from Sasol) and diluted nitric acid ($HNO_3$) (ignition of loss: 70 wt. %) was added, which pasted the mixture to form a dough by adding an appropriate amount of water. The dough was extruded with an extruder to form a cylindered extrudate. The extrudate was dried at 110° C. overnight, and calcinated at 500° C. for 4 hours.

Example 3—Analysis of Prepared Hydrocracking Catalysts

The prepared catalysts of Examples 1 and 2 were analyzed by BET analysis no determine surface area and pore volume. Additionally, micropore (less than 2 nm) and mesopore (greater than 2 nm) surface area and pore volume were determined. The results are shown in Table 2, which shows the catalyst of Example 1 (conventional) had more micropore surface area and micropore pore volume than mesopore surface area and mesopore pore volume. Additionally, the catalyst of Example 2 had more mesopore surface area and mesopore pore volume than micropore surface area and micropore pore volume. These results indicate that the catalyst of Example 1 was microporous (that is, average pore size of less than 2 nm) and the catalyst of Example 2 was mesoporous (that is, average pore size of at least 2 nm).

TABLE 2

Porosity Analysis of Catalysts of Example 1 and Example 2

| Sample | Catalyst of Example 2 (conventional) | Catalyst of Example 1 |
|---|---|---|
| Surface area ($m^2/g$) | 902 | 895 |
| Micropore (<2 nm) ($m^2/g$) | 747 | 415 |
| Mesopore (>2 nm) ($m^2/g$) | 155 | 480 |
| Mesopore ratio (%) | 17.2 | 53.6 |
| Pore volume, mL/g | 0.69 | 1.05 |
| Micropore (<2 nm), (mL/g) | 0.41 | 0.25 |
| Mesopore (>2 nm). (mL/g) | 0.28 | 0.8 |
| Mesopore ratio (%) | 40.6 | 76.2 |

Example 4—Preparation of Mesoporous HDN Catalyst

A mesoporous HDN catalyst was fabricated by the method described, where the mesoporous HDN catalyst had a measured average pore size of 29.0 nm. First, 50 g of mesoporous alumina was prepared by mixing 68.35 g of boehmite alumina powder (commercially available as CATAPAL® from Sasol) in 1000 mL of water at 80° C. Then, 378 mL of 1 M $HNO_3$ was added with the molar ratio of $H^+$ to $Al^{3+}$ equal to 1.5 and the mixture was kept stirring at 80° C. for 6 hours to obtain a sol. Then, 113.5 g of triblock copolymer (commercially available as PLURONIC® P123 from BASF) was dissolved in the sol at room temperature and then aged for 3 hours, where the molar ratio of the copolymer to Al was equal to 0.04). The mixture was then dried at 110° C. overnight and then calcined at 500° C. for 4 hours to form a mesoporous alumina.

The catalyst was prepared from the mesoporous alumina by mixing 50 g (dry basis) of the mesoporous alumina with 41.7 g (12.5 g of alumina on dry basis) of acid peptized alumina (commercially available as CATAPAL® from Sasol). An appropriate amount of water was added to the mixture to form a dough, and the dough material was extruded to form trilobe extrudates. The extrudates were dried at 110° C. overnight and calcinated at 550° C. for 4 hours. The calcinated extrudates were wet incipient impregnated with 50 mL of aqueous solution containing 94.75 g of ammonium heptanmolybdate, 12.5 g of nickel nitrate, and 3.16 g of phosphoric acid. The impregnated catalyst was dried 110° C. overnight and calcinated at 500° C. for 4 hours.

Example 5—Preparation of Conventional HDN Catalyst

A catalyst was prepared from the conventional alumina by mixing 50 g (dry basis) of the alumina (commercially available as PURALOX® HP 14/150 from Sasol) with 41.7 g (that is, 12.5 g of alumina on dry basis) of acid peptized alumina (commercially available as CATAPAL® from Sasol). Appropriate amount of water was added to the mixture to form a dough, and the dough material was extruded to form trilobe extrudates. The extrudates were dried at 110° C. overnight and calcinated at 550° C. for 4 hours. The calcinated extrudates were wet incipient impregnated with 50 mL of aqueous solution containing 94.75 g of ammonium heptanmolybdate, 12.5 g of nickel nitrate, and 3.16 g of phosphoric acid. The impregnated catalyst was dried 110° C. overnight and calcinated at 500° C. for 4 hours. The conventional HDN catalyst had a measured average pore size of 10.4 nm.

Example 6—Catalytic Performance of Prepared HDN Catalysts

In order to compare the reaction performance of the catalysts of Example 4 and Example 5, both catalysts were tested in a fixed bed reactor. For each run, 80 mL of the selected catalyst was loaded. The feedstock properties, operation conditions, and results are summarized in Table 3. The results showed that the hydrodenitrogenation performance of the catalyst of Example 4 is better than that of the conventional catalyst of Example 5.

TABLE 3

Porosity Analysis of Catalysts of Example 4 and Example 5

| Catalyst | Feed Oil | Example 5 | Example 4 |
|---|---|---|---|
| Conditions | | | |
| Temperature (° C.) | | 390 | 390 |
| Pressure (bar) | | 150 | 150 |
| Liquid hourly space velocity (LHSV) (hours$^{-1}$) | | 0.5 | 0.5 |
| $H_2$/oil ratio (L/L) | | 1200 | 1200 |
| Product properties | | | |
| Density | 0.8607 | 0.8423 | 0.8391 |
| C (wt. %) | 85.58 | 86.43 | 86.51 |
| H (wt %) | 12.37 | 13.45 | 13.44 |
| S (ppmw) | 19810 | 764 | 298 |
| N (ppmw) | 733 | 388 | 169 |
| C5-180° C. (wt. %) | 20.19 | 17.00 | 17.62 |
| 180-350° C. (wt. %) | 30.79 | 36.93 | 39.00 |
| 350-540° C. (wt. %) | 30.27 | 30.65 | 29.12 |
| >540° C. (wt. %) | 18.75 | 14.32 | 12.67 |

Example 7—Catalytic Performance of HDN and Hydrotreating Catalysts

To compare a conventional catalyst system which includes the catalyst of Example 2 and the catalyst of Example 5 with a catalyst system including the catalyst of Example 1 and the catalyst of Example 4, experiments were performed in a four bed reactor system. The four bed reactor unit included an HDM catalyst, a transition catalyst, an HDN catalyst, and a hydrocracking catalyst, all in series. The feed and reactor conditions were the same as those reported in Table 3. Table 4 shows the components and volumetric amount of each component in the sample systems. The 300 mL reactor was utilized for the testing.

TABLE 4

Catalyst Bed Loading

| | Sample System 1 (Conventional) | Sample System 2 | Volume (mL) |
|---|---|---|---|
| HDM Catalyst | KFR-22 (commerically available from Albemarle) | KFR-22 (commerically available from Albemarle) | 15 |
| Transition Catalyst | KFR-33 (commercial available from Albemarle) | KFR-33 (commercial available from Albemarle) | 15 |
| HDN Catalyst | Catalyst of Example 5 | Catalyst of Example 4 | 90 |
| Hydrocracking Catalyst | Catalyst of Example 2 | Catalyst of Example 1 | 30 |

Table 5 reports the catalytic results for Sample System 1 and Sample System 2 of Table 4 with liquid hourly space velocities of 0.2 hour$^{-1}$ and 0.3 hour$^{-1}$. The results showed that the catalyst system which included the catalysts of Example 1 and Example 4 exhibited a better performance in hydrodenitrogenation, hydrodesulfurization, and conversion of 540° C.+ residues.

TABLE 5

Catalyst Performance Results

| | LHSV (hour$^{-1}$) | | | |
|---|---|---|---|---|
| | 0.2 | | 0.3 | |
| | Catalyst system | | | |
| | Sample System 1 (Conventional) | Sample System 2 | Sample System 1 (Conventional) | Sample System 2 |
| Product properties | | | | |
| Density | 0.8306 | 0.771 | 0.8442 | 0.8181 |
| S (ppmw) | 73 | 230 | 301.7 | 238 |
| N (ppmw) | 5 | <5 | 237.3 | 23 |
| Product yield, wt % FF | | | | |
| C1 | 0.3 | 0.4 | 0.4 | 0.6 |
| C2 | 0.3 | 0.6 | 0.4 | 0.3 |
| C3 | 0.4 | 2.1 | 0.8 | 0.5 |
| nC4 | 0.1 | 3.8 | 0.1 | 0.1 |
| iC4 | 0.4 | 2.7 | 0.5 | 0.6 |
| <180° C. | 18.4 | 53.3 | 17.0 | 24.4 |
| 180-350° C. | 41.4 | 31.7 | 37.4 | 46.1 |
| 350-540° C. | 30.5 | 3.2 | 30.6 | 22.0 |
| >540° C. | 8.4 | 0.0 | 13.0 | 3.9 |
| C5+ | 98.7 | 88.1 | 98.1 | 96.4 |

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A process for upgrading heavy oil, the process comprising:

removing at least a portion of metals from the heavy oil in a hydrodemetalization reaction zone to form a hydrodemetalization reaction effluent;

removing at least a portion of metals and at least a portion of nitrogen from the hydrodemetalization reaction effluent in a transition reaction zone to form a transition reaction effluent, where the transition reaction zone is positioned downstream of the hydrodemetalization reaction zone;

removing at least a portion of nitrogen from the transition reaction effluent in a hydrodenitrogenation reaction zone to form a hydrodenitrogenation reaction effluent, where the hydrodenitrogenation reaction zone is positioned downstream of the transition reaction zone;

reducing aromatics content in the hydrodenitrogenation reaction effluent in a hydrocracking reaction zone to form an upgraded fuel, where:

the hydrocracking reaction zone is positioned downstream of the hydroprocessing reaction zone;

the hydrocracking reaction zone comprises a hydrocracking catalyst comprising a mesoporous zeolite and one or more metals, where the mesoporous zeolite has an average pore size of from 2 nm to 50 nm;

the aromatics content is reduced in the hydrodenitrogenation reaction effluent in the hydrocracking reaction zone by contacting the hydrodenitrogenation reaction effluent with the hydrocracking catalyst; and the hydrodenitrogenation reaction zone comprises a hydrodenitrogenation catalyst comprising one or more metals on an alumina support, the alumina support having an average pore size of from 25 nm to 50 nm.

2. The process of claim 1, where the hydrodemetalization reaction zone comprises a hydrodemetalization catalyst, and the metal is removed from the heavy oil in the hydrodemetalization reaction zone by contacting the heavy oil with the hydrodemetalization catalyst, where the hydrodemetalization catalyst comprises molybdenum.

3. The process of claim 1, where the transition reaction zone comprises a transition catalyst, and the metal and nitrogen is removed from the hydrodemetalization reaction effluent in the transition reaction zone by contacting the hydrodemetalization reaction effluent with the transition catalyst, where the transition catalyst comprises molybdenum and nickel.

4. The process of claim 1, where the hydrodenitrogenation reaction zone comprises a hydrodenitrogenation catalyst, and the nitrogen is removed from the transition reaction effluent in the hydrodenitrogenation reaction zone by contacting the transition reaction effluent with the hydrodenitrogenation catalyst, where the hydrodenitrogenation catalyst comprises molybdenum and nickel.

5. The process of claim 1, where the hydrodenitrogenation catalyst comprises:

from 10 wt. % to 18 wt. % of an oxide or sulfide of molybdenum;

from 2 wt. % to 8 wt. % of an oxide or sulfide of nickel; and from 74 wt. % to 88 wt. % of alumina.

6. The process of claim 1, where hydrocracking catalyst comprises tungsten and nickel.

7. The process of claim 1, where the hydrocracking catalyst comprises:

from 18 wt. % to 28 wt. % of an oxide or sulfide of tungsten;

from 2 wt. % to 8 wt. % of an oxide or sulfide of nickel; and from 5 wt. % to 40 wt. % of zeolite.

8. The process of claim 1, where hydrocracking catalyst comprises molybdenum and nickel.

9. The process of claim 1, where the hydrocracking catalyst comprises:

from 12 wt. % to 18 wt. % of an oxide or sulfide of molybdenum;

from 2 wt. % to 8 wt. % of an oxide or sulfide of nickel; and from 5 wt. % to 40 wt. % of zeolite.

10. The process of claim 1, where the heavy oil comprises crude oil, where the crude oil has an American Petroleum Institute (API) gravity of from 25 degrees to 50 degrees.

11. The process of claim 1, further comprising processing the upgraded fuel to form one or more petrochemical fractions.

12. The process of claim 1, where the processing of the upgraded fuel comprises a hydrocracking process.

13. The process of claim 1, where the processing of the upgraded fuel comprises fluid catalytic cracking.

14. A process for upgrading heavy oil, the process comprising:

introducing a stream comprising the heavy oil to a hydrodemetalization reaction zone comprising hydrodemetalization catalyst;

removing at least a portion of metals from the heavy oil in a hydrodemetalization reaction zone to form a hydrodemetalization reaction effluent;

passing the hydrodemetalization reaction effluent from the hydrodemetalization reaction zone to a transition reaction zone comprising a transition catalyst;

removing at least a portion of metals and a portion of nitrogen from the hydrodemetalization reaction effluent in the transition reaction zone to form a transition reaction effluent;

passing the transition reaction effluent from the transition reaction zone to a hydrodenitrogenation reaction zone comprising a hydrodenitrogenation catalyst, where the hydrodenitrogenation catalyst comprises one or more metals on an alumina support, the alumina support having an average pore size of from 25 nm to 50 nm;

removing at least a portion of nitrogen from the transition reaction effluent in the hydrodenitrogenation reaction zone to form a hydrodenitrogenation reaction effluent;

passing the hydrodenitrogenation reaction effluent to a hydrocracking reaction zone comprising a hydrocracking catalyst, where the hydrocracking catalyst comprises a mesoporous zeolite and one or more metals, where the mesoporous zeolite has an average pore size of from 2 nm to 50 nm; and reducing aromatics content in the hydrodenitrogenation reaction effluent in the hydrocracking reaction zone to form an upgraded fuel.

15. The process of claim 14, where hydrocracking catalyst comprises tungsten and nickel.

16. The process of claim 14, where hydrocracking catalyst comprises molybdenum and nickel.

17. A hydroprocessing reactor comprising:

a hydrodemetalization catalyst;

a transition catalyst positioned downstream of the hydrodemetalization catalyst;

a hydrodenitrogenation catalyst positioned downstream of the transition catalyst, where the hydrodenitrogenation catalyst comprises one or more metals on an alumina support, the alumina support having an average pore size of from 25 nm to 50 nm; and a hydrocracking catalyst positioned downstream of the hydrodenitrogenation catalyst, the hydrocracking catalyst comprising a mesoporous zeolite and one or more metals, where the mesoporous zeolite has an average pore size of from 2 nm to 50 nm.

18. The process of claim 17, where hydrocracking catalyst comprises tungsten and nickel.

19. The process of claim 17, where hydrocracking catalyst comprises molybdenum and nickel.

20. A process for upgrading heavy oil, the process comprising:

removing at least a portion of metals from the heavy oil in a hydrodemetalization reaction zone to form a hydrodemetalization reaction effluent;

removing at least a portion of metals and at least a portion of nitrogen from the hydrodemetalization reaction effluent in a transition reaction zone to form a transition reaction effluent, where the transition reaction zone is positioned downstream of the hydrodemetalization reaction zone;

removing at least a portion of nitrogen from the transition reaction effluent in a hydrodenitrogenation reaction zone to form a hydrodenitrogenation reaction effluent, where:

the hydrodenitrogenation reaction zone is positioned downstream of the transition reaction zone; and the hydrodenitrogenation reaction zone comprises a hydrodenitrogenation catalyst comprising one or more metals on an alumina support, the alumina support having an averages pore size of from 25 nm to 50 nm; and and the nitrogen is removed from the transition reaction effluent in the hydrodenitrogenation reaction zone by contacting the transition reaction effluent with the hydrodenitrogenation catalyst; and reducing aromatics content in the hydrodenitrogenation reaction effluent in a hydrocracking reaction zone by to form an upgraded fuel, where the hydrocracking reaction zone is positioned downstream of the hydrodenitrogenation reaction zone.

21. The process of claim 20, where the hydrodemetalization reaction zone comprises a hydrodemetalization catalyst, and the metal is removed from the heavy oil in the hydrodemetalization reaction zone by contacting the heavy oil with the hydrodemetalization catalyst, where the hydrodemetalization catalyst comprises molybdenum.

22. The process of claim 20, where the transition reaction zone comprises a transition catalyst, and the metal and nitrogen is removed from the hydrodemetalization reaction effluent in the transition reaction zone by contacting the hydrodemetalization reaction effluent with the transition catalyst, where the transition catalyst comprises molybdenum and nickel.

23. The process of claim 20, where the hydrodenitrogenation catalyst comprises molybdenum and nickel.

24. The process of claim 20, where the hydrodenitrogenation catalyst comprises:

from 10 wt. % to 18 wt. % of an oxide or sulfide of molybdenum;

from 2 wt. % to 8 wt. % of an oxide or sulfide of nickel; and from 74 wt. % to 88 wt. % of alumina.

25. The process of claim 20, where the hydrocracking reaction zone comprises a hydrocracking catalyst comprising tungsten and nickel.

26. The process of claim 25, where the hydrocracking catalyst comprises:

from 18 wt. % to 28 wt. % of an oxide or sulfide of tungsten;

from 2 wt. % to 8 wt. % of an oxide or sulfide of nickel; and from 5 wt. % to 40 wt. % of zeolite.

27. The process of claim 20, where the hydrocracking reaction zone comprises a hydrocracking catalyst comprising molybdenum and nickel.

28. The process of claim 27, where the hydrocracking catalyst comprises:

from 12 wt. % to 18 wt. % of an oxide or sulfide of molybdenum;

from 2 wt. % to 8 wt. % of an oxide or sulfide of nickel; and from 5 wt. % to 40 wt. % of zeolite.

29. The process of claim 20, where the heavy oil comprises crude oil, where the crude oil has an American Petroleum Institute (API) gravity of from 25 degrees to 50 degrees.

30. The process of claim 20, further comprising processing the upgraded fuel to form one or more petrochemical fractions.

31. The process of claim 20, where the processing of the upgraded fuel comprises a hydrocracking process.

32. The process of claim 20, where the processing of the upgraded fuel comprises fluid catalytic cracking.

33. A process for upgrading heavy oil, the process comprising:

introducing a stream comprising the heavy oil to a hydrodemetalization reaction zone comprising hydrodemetalization catalyst;

removing at least a portion of metals from the heavy oil in a hydrodemetalization reaction zone to form a hydrodemetalization reaction effluent;

passing the hydrodemetalization reaction effluent from the hydrodemetalization reaction zone to a transition reaction zone comprising a transition catalyst;

removing at least a portion of metals and a portion of nitrogen from the hydrodemetalization reaction effluent in the transition reaction zone to form a transition reaction effluent;

passing the transition reaction effluent from the transition reaction zone to a hydrodenitrogenation reaction zone comprising a hydrodenitrogenation catalyst, where the hydrodenitrogenation catalyst comprises one or more metals on an alumina support, the alumina support having an average pore size of from 25 nm to 50 nm;

removing at least a portion of nitrogen from the transition reaction effluent in the hydrodenitrogenation reaction zone to form a hydrodenitrogenation reaction effluent;

passing the hydrodenitrogenation reaction effluent to a hydrocracking reaction zone comprising a hydrocracking catalyst; and reducing aromatics content in the hydrodenitrogenation reaction effluent in the hydrocracking reaction zone to form an upgraded fuel, where the hydrocracking reaction zone comprises a hydrocracking catalyst.

34. The process of claim 20, where the hydrodenitrogenation catalyst comprises molybdenum and nickel.

35. A hydroprocessing reactor comprising:

a hydrodemetalization catalyst;

a transition catalyst positioned downstream of the hydrodemetalization catalyst;

a hydrodenitrogenation catalyst positioned downstream of the transition catalyst, where the hydrodenitrogenation catalyst comprises one or more metals on an alumina support, the alumina support having an average pore size of from 25 nm to 50 nm; and a hydrocracking catalyst positioned downstream of the hydrodenitrogenation catalyst.

36. The reactor of claim 35, where the hydrodenitrogenation catalyst comprises molybdenum and nickel.

37. The process of claim 1, where each of the hydrodemetalization reaction zone, the transition reaction zone, the hydrodenitrogenation reaction zone, and the hydrocracking reaction zone comprise a fixed bed.

38. The process of claim 14, where each of the hydrodemetalization reaction zone, the transition reaction zone, the hydrodenitrogenation reaction zone, and the hydrocracking reaction zone comprise a fixed bed.

39. The reactor of claim 17, where each of the hydrodemetalization catalyst, the transition catalyst, the hydrodenitrogenation catalyst, and the hydrocracking catalyst are in a fixed bed.

* * * * *